US005286009A

United States Patent [19]

Moore et al.

[11] Patent Number: 5,286,009

[45] Date of Patent: Feb. 15, 1994

[54] DEVICE FOR CONTROLLING THE POURING OF MOLTEN MATERIALS

[75] Inventors: Alan F. Moore, Knoxville; Alfred L. Duncan, Clinton, both of Tenn.

[73] Assignee: Martin Marietta Energy Systems, Inc., Oak Ridge, Tenn.

[21] Appl. No.: 934,404

[22] Filed: Aug. 24, 1992

[51] Int. Cl.[5] ..... B22D 41/18

[52] U.S. Cl. ..... 266/236; 222/597; 222/602

[58] Field of Search ..... 266/236; 222/597, 598, 222/599, 602

[56] References Cited

U.S. PATENT DOCUMENTS

| | | | |
|---|---|---|---|
| 2,824,732 | 2/1958 | Harris | 266/236 |
| 3,651,825 | 3/1972 | Sury | 137/240 |
| 4,601,415 | 7/1986 | Koffron | 222/597 |
| 4,709,903 | 12/1987 | LaBate | 266/227 |
| 4,799,650 | 1/1989 | LaBate | 266/227 |

FOREIGN PATENT DOCUMENTS

| | | | |
|---|---|---|---|
| 3743383 | 7/1989 | Fed. Rep. of Germany | 222/602 |

*Primary Examiner*—Scott Kastler

*Attorney, Agent, or Firm*—Martin J. Skinner; Joseph A. Marasco; Herman L. Holsopple

[57] ABSTRACT

A device for controlling the pouring of a molten material from a crucible or other container. The device (10) includes an annular retainer ring (12) for mounting in the drain opening in the bottom of a conventional crucible (16), the retainer ring defining a opening (14) therethrough. The device (10) also includes a plug member (22) having an annular forward end portion (24) for force-fit reception in the opening (14) of the retainer ring (12) to selectively seal the opening (14) and for being selectively forced through the opening (14). The plug member (22) has a rear end portion (26) for being positioned within the crucible (16), the rear end portion (26) including stop means for prohibiting the rear end portion from passing through the opening (14) in the retainer ring (12) when the forward end portion (24) is selectively forced through the opening. The plug member (22) defines at least one, and preferably a plurality of flutes (32), each extending from a point rearward the annular forward end portion (24) of the plug member (22), and forward the stop means, to a point rearward of the stop means. The flutes (32) permit fluid communication between the interior and exterior of the crucible (16) when the forward end portion (24) of the plug member (22) is forced through the opening (14) in the retaining ring (12) such that the molten material is allowed to flow from the crucible (16).

18 Claims, 4 Drawing Sheets

DEVICE FOR CONTROLLING THE POURING OF MOLTEN MATERIALS

This invention was made with Government support under contract DE-AC05-840R21400 awarded by the U.S. Department of Energy to Martin Marietta Energy Systems, Inc. and the Government has certain rights in this invention.

TECHNICAL FIELD

This invention relates to a device for controlling the pouring of molten materials from a crucible or other container. In this particular invention the device includes a retainer ring for circumscribing the drain opening in the crucible and a plug for selectively sealing an opening in the retainer ring.

BACKGROUND ART

Crucibles for the melting and pouring of molten materials such as molten metals typically are provided with drain openings disposed in the bottom of the crucible to facilitate the pouring of the molten material from the crucible into a mold. However, heretofore difficulty has been encountered in devising suitable mechanisms for sealing the drain opening of the crucible while the charge material is being melted within the crucible and for selectively unsealing the drain opening to accommodate the pouring of the molten material from the crucible.

One apparatus which has been utilized in the past is a pouring rod which is provided with an distal end for being received in the drain opening to selectively seal the opening. In this regard, the pouring rod is inserted into an opening in the top of the crucible and the distal end is inserted into the drain opening in the crucible. The charge material to be melted is then loaded into the crucible and melted. When pouring of the molten material is desired the pouring rod is removed upwardly, thereby removing the distal end of the rod from the drain opening. However, the necessary presence of the pouring rod in the crucible during the loading of the charge material can obstruct the loading process and may limit the amount of charge material which can be loaded. Further, such pouring rods can be broken during the loading of the charge material, or during the melting process, causing a premature pouring or leaving the drain opening sealed with the distal end of the pouring rod.

Rupture disks are also commonly used to selectively seal the drain openings of crucibles. A rupture disk is received in the drain opening to seal the opening while the charge is loaded and the charge material is melted. When pouring is desired a pouring rod is inserted into the crucible and used to apply force to the disk such that it ruptures and opens the drain opening to the flow of molten material. An example of such a rupture disk apparatus is disclosed in U.S. Pat. No. 2,824,732. Whereas, the rupture disk obviates the inconvenience of having to leave the pouring rod in the crucible during the loading and melting process, premature pourings (cold pourings) are common due to premature fracturing or rupture of the disk, and failure to pour can result due to inadequate pouring force applied to a ruptured disk or resistance of the disks to fracture. Moreover, even where the disk ruptures in a timely manner, disk material can contaminate the molten material causing defects in the casting which is produced or otherwise compromising the molding process.

Other devices relating to the pouring of molten materials are disclosed in U.S. Pat. Nos. 4,799,650; 4,709,903; 4,601,415; and 3,651,825.

Therefore, it is an object of the present invention to provide a device for controlling the pouring of molten material from a crucible or other container for molten materials.

It is another object of the present invention to provide a device for controlling the pouring of molten materials from a crucible which effectively seals the drain opening in a crucible and avoid the premature pouring of the molten materials from the crucible.

Yet another object of the present invention is to provide a device for controlling the pouring of a molten material which does not contaminate the molten material or otherwise compromise the quality of the casting being produced.

Still another object of the present invention is to provide a device for controlling the pouring of a molten material which is reusable.

DISCLOSURE OF THE INVENTION

Other objects and advantages will be accomplished by the present invention which provides a device for controlling the pouring of a molten material from a crucible or other container. The device includes an annular retainer ring for mounting in the drain opening in the bottom of a conventional crucible or other container for melting and/or holding molten material, the retainer ring defining a opening therethrough. The device also includes a plug member having an annular forward end portion for force-fit reception in the opening of the retainer ring to selectively seal the opening and for being selectively forced through the opening. The plug member has a rear end portion for being positioned within the crucible, the rear end portion including stop means for prohibiting the rear end portion from passing through the opening in the retainer ring when the forward end portion is selectively forced through the opening. The plug member defines at least one, and preferably a plurality of flutes, each extending from a point rearward the annular forward end portion of the plug member, and forward the stop means, to a point rearward of the stop means. The flutes permit fluid communication between the interior and exterior of the crucible when the forward end portion of the plug is forced through the opening in the retaining ring such that the molten material is allowed to flow from the crucible through such opening.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
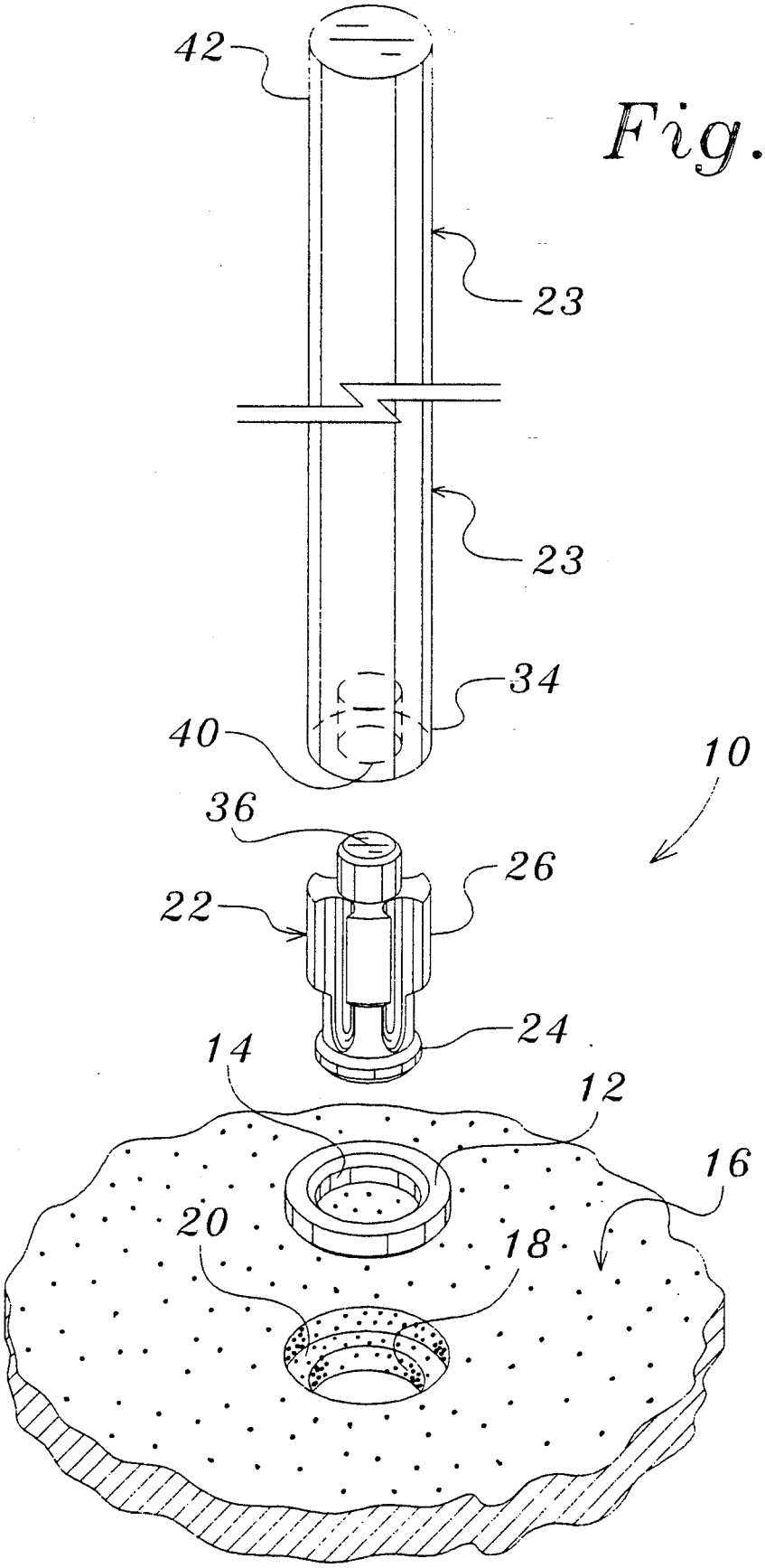
FIG. 1 illustrates a perspective view of the pouring device of the present invention.

A device for controlling the pouring of molten materials incorporating various features of the present invention is illustrated at 10 in the Figures. The device 10 is designed to selectively seal the opening in the bottom of a crucible through which molten materials are poured, and to facilitate the selective pouring of such molten materials into a mold. However, it will be recognized that the device 10 can be used as a closure for various containers for holding molten materials and to facilitate the pouring of molten materials from such containers. Further, whereas the device 10 is particularly well suited for use in the pouring of molten metals, it will be appreciated that the device 10 can be used to facilitate the pouring of plastic, rubber or various other solidifying materials.

In the preferred illustrated embodiment the device 10 includes an annular retainer ring holding molten material, the retainer ring 12 defining an opening 14 therethrough. In this regard, typically a crucible, such as the illustrated crucible 16 (only the bottom of which is shown in the Figures) is provided with an opening 18 through which molten material is poured when a mold is being filled. The retaining ring 12 is configured to be closely received in a recess 20 which circumscribes the opening 18 on the interior of the bottom wall of the crucible 16. Preferably, the retainer ring 12 is dimensioned for force-fit reception in the recess 20 such that the retaining ring 12 remains in place in the recess 20 during use, but can be readily removed from the recess 20 for cleaning or replacement.

The device 10 also includes a plug member 22. The plug member 22 has an annular forward end portion 24 and a rear end portion 26, the forward end portion 24 of the device 10 defining a cross-sectional diameter suitable for force-fit reception in the opening 14 of the retainer ring 12 so as to seal the opening 14 against the flow of molten material. For example, in one preferred embodiment where both the retainer ring 20 and the plug member 22 are fabricated of graphite, the diameter of the opening 14 is approximately 1.248 inches and the cross-sectional diameter of the forward end portion 24 is approximately 1.25 inches. As a result, the forward end portion 24 of the plug portion 24 is approximately 1.25 inches. As a result, the forward end portion 24 of the plug member 22 can be inserted into the opening 14 to seal such opening without excessive force and without substantial deformation of the retainer ring 12 or the plug member 22.

In order to facilitate the insertion of the forward end portion 24 of the plug member 22 into the opening 14, the preferred embodiment of the retainer ring 12 is provided with a bevelled edge 15 which circumscribes the opening 14 of the ring 12. Further, the forward end portion 24 of the plug member 22 is provided with a bevelled outboard edge 28 which, in cooperation with the bevelled edge 15, serves to locate the forward end portion 24 of the plug member 22 for proper insertion into the opening 14.

Rearward of the forward end portion 24 the plug member 22 defines a waist portion 30 having a preselected cross-sectional diameter which is smaller than the cross-sectional diameter of the forward end portion 24 of the plug member. As will be discussed further below, the smaller diameter of the waist portion 30 is provided to allow free downward movement of the waist portion 30 through the opening 14 of the retainer ring 12 upon the forward end portion 24 of the plug member 22 being inserted through the opening 14.

The plug member 22 is also provided with stop means for prohibiting the rear end portion 26 of the plug member 22 from travelling through the opening 14. In this regard, in the preferred illustrated embodiment the rear end portion 26 of the plug member 22 defines a preselected cross-sectional diameter which is greater than the cross-sectional diameter of the forward end portion 24 of the plug member and sufficiently greater than the diameter of the opening 14 in the retainer ring 12 to prohibit movement of the rear end portion 26 through the opening 14. Accordingly, the rear end portion 26, with its increased diameter, serves as the stop means in the preferred embodiment. However, it will be appreciated that other suitable stop means can be used if desired.

The plug member 22 also defines at least one, and generally a plurality of, flutes 32 which provide passageways for selectively accommodating the flow of molten material from the crucible 16. Each of the flutes extends from a point rearward of the forward end portion 24, and forward of the point at which the stop means of the plug member 22 selectively engages the retainer ring 14, to a point rearward of the point at which the stop means of the plug member 22 selectively engages the retainer ring 14. For example, in the preferred illustrated embodiment, the flutes 32 extend substantially the entire length of the waist portion 30 and the rear end portion 26 of the plug member 22.

In the preferred embodiment, a suitable coupling means is also provided which allows the outboard end 34 of the pouring rod 23 to releasably engage the plug member 22. In the illustrated embodiment such coupling means includes a protruding member 36 provided on the rearward surface 38 of the plug member 22 which is closely received in a receptor 40 provided in the outboard end 34 of the pouring rod 23. Of course, other suitable coupling means can be used if desired.

Figure 2:
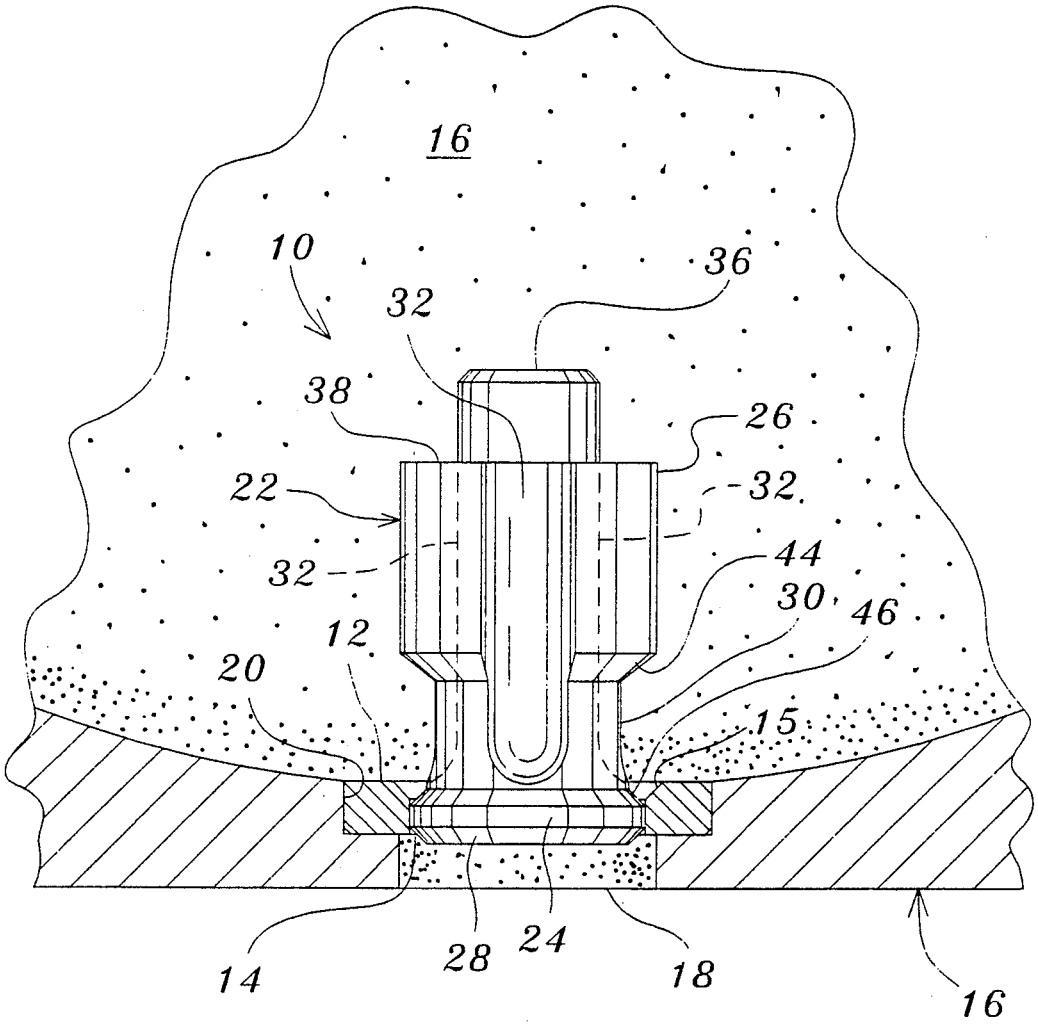
FIG. 2 illustrates a side elevation view, partially in section, of a pouring device of the present invention.
Figure 3:
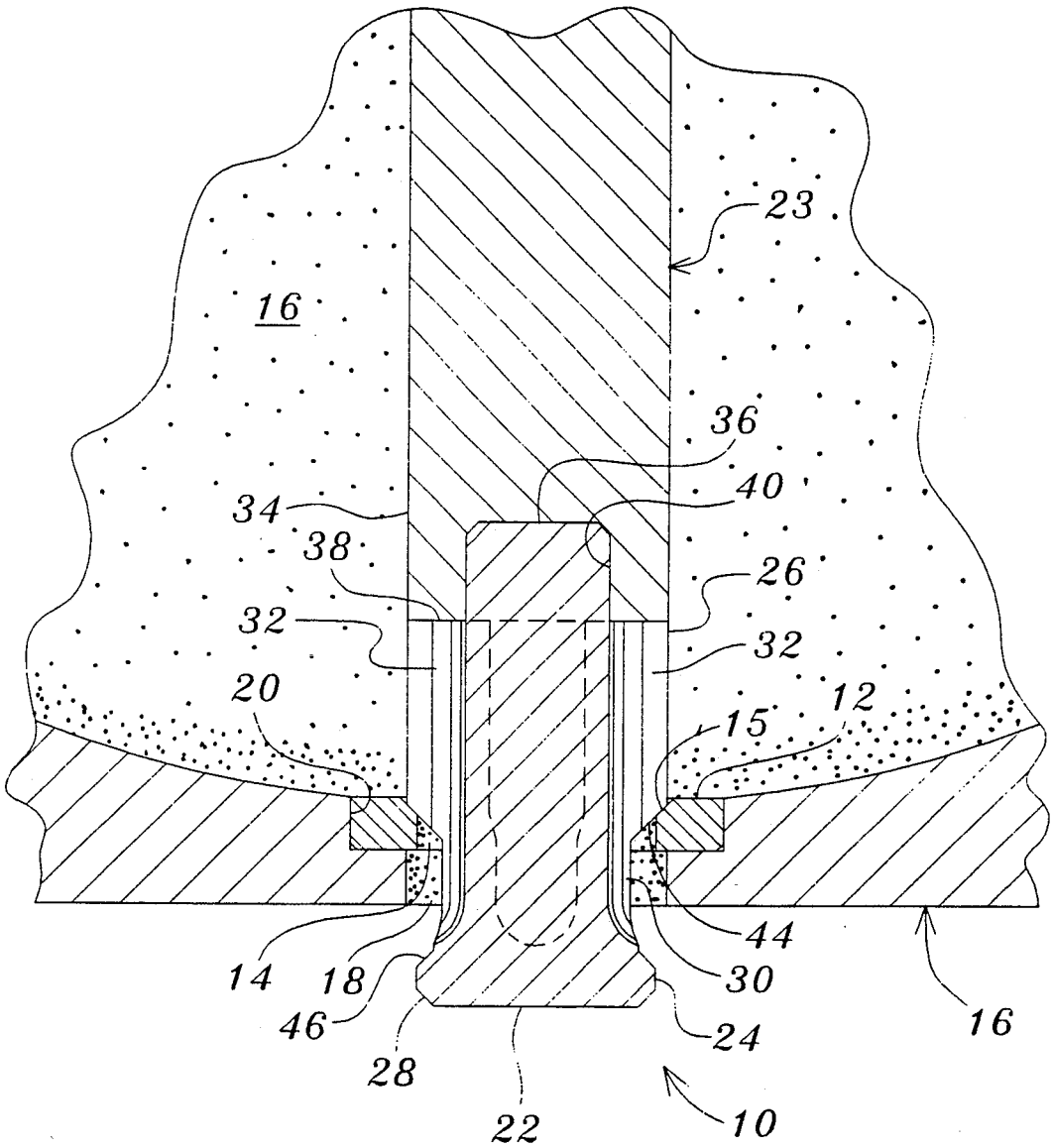
FIG. 3 illustrates a side elevation view, in section, of a pouring device of the present invention.
Figure 4:
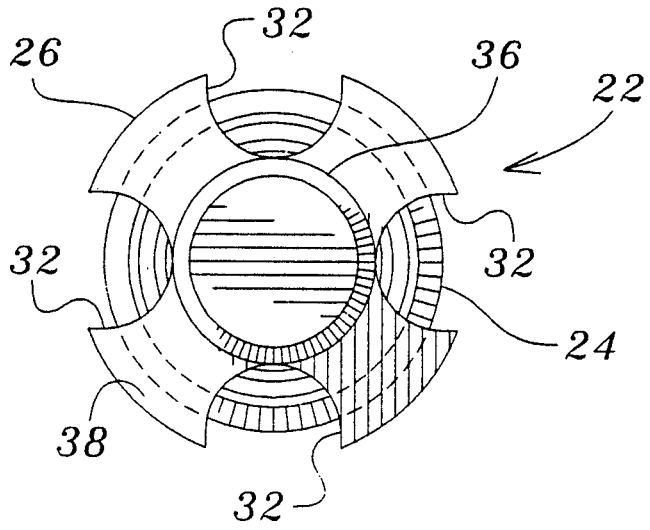
FIG. 4 illustrates a rear view of the plug member of a pouring device of the present invention.

Referring to FIGS. 2 and 3 and the manner in which the device 10 is typically used, the retainer ring 12 is inserted into the recess 20 of the crucible 16, and, as illustrated in FIG. 2, the forward end portion 24 of the plug member is inserted into the opening 14 of the retainer ring 12 so as to seal the opening 14. The charge material to be melted is then loaded into the crucible 16 and heat is applied to accomplish the melting of the charge material. Of course, the device 10 does not require that a pouring rod remain in place and, thus, the loading of the charge material is not obstructed.

After the charge material reaches a molten state, and in order to initiate the pouring of the molten material from the crucible 16, the pouring rod 23 (or similar tool) is inserted into the crucible 16 and the outboard end 34 of the rod 23 is positioned such that the protruding member 36 of the plug member 22 is received in the receptor 40 of the rod 23. Axial force is then applied to the pouring rod 23, as by striking the proximal end 42 of the rod (See FIG. 1) with a hammer or other striking device, thereby forcing the forward end portion 24 of the plug member 22 downwardly through the opening 14 of the retainer ring 12.

As noted above, the smaller diameter of the waist portion 30 allows the waist portion to travel freely through the opening 14, with the rear end portion 26 serving to stop the downward travel of the plug member 22 through the opening 14 as illustrated in FIG. 3. It will be noted that in the preferred embodiment of the plug member 22 the transition from the cross-sectional diameter of the waist portion 30 to the larger cross-sectional diameter of the rear end portion 26 is preferably accomplish with a bevelled shoulder 44 which is angled so as to be substantially abuttable with the surfaced of the bevelled edge 15 of the retainer ring 12. Typically, the bevelled shoulder 44 and bevelled edge 15 define forty-five degree angles. Providing the bevelled shoulder 44 reduces the likelihood that the plug member 22 and/or retainer ring 12 will be damaged as the rear end portion 26 of the plug member 22 comes in contact with the retaining ring 15.

It will be recognized that with the plug member 22 extending through the opening 14, as illustrated in FIG. 3, the flutes 32 serve as passageways communicating between the interior and exterior of the crucible 16 through which molten material is allowed to pour from the crucible 16. Thus, the plug member 22 remains in the opening 14 during the pouring operation, obviating the risk that the plug member 22, or portions thereof, might fall into the mold being filled and contaminate the molten material or otherwise compromise the casting process. It will also be noted that the size and number of the flutes 32 which are provided in the plug member 22 determine the rate of flow of molten material from the crucible. Therefore, it is contemplated that plug members 22 having varying numbers or/and sizes of flutes can be utilized depending upon the molten material being poured and the flow rate desired.

After the molten material has been poured from the crucible 16, the plug member 22 can be removed from the retainer ring 12 by applying upward force to the forward end portion 24 of the plug member such that the forward end portion 24 is forced back through the opening 14. As a result, the plug member 22 can be cleaned and reused if desired. In order to facilitate the removal of the plug member 22 from the retainer ring 12 the forward end portion 24 is preferably provided with a bevelled rearward surface 46.

It will be recognized by those skilled in the art that the retainer ring 12 and the plug member 22 can be fabricated of various materials depending upon the molten material to be poured. However, graphite or a ceramic are examples of fabricating materials which are particularly well suited for use where the molten material to be poured is a molten metal.

Figure 5:
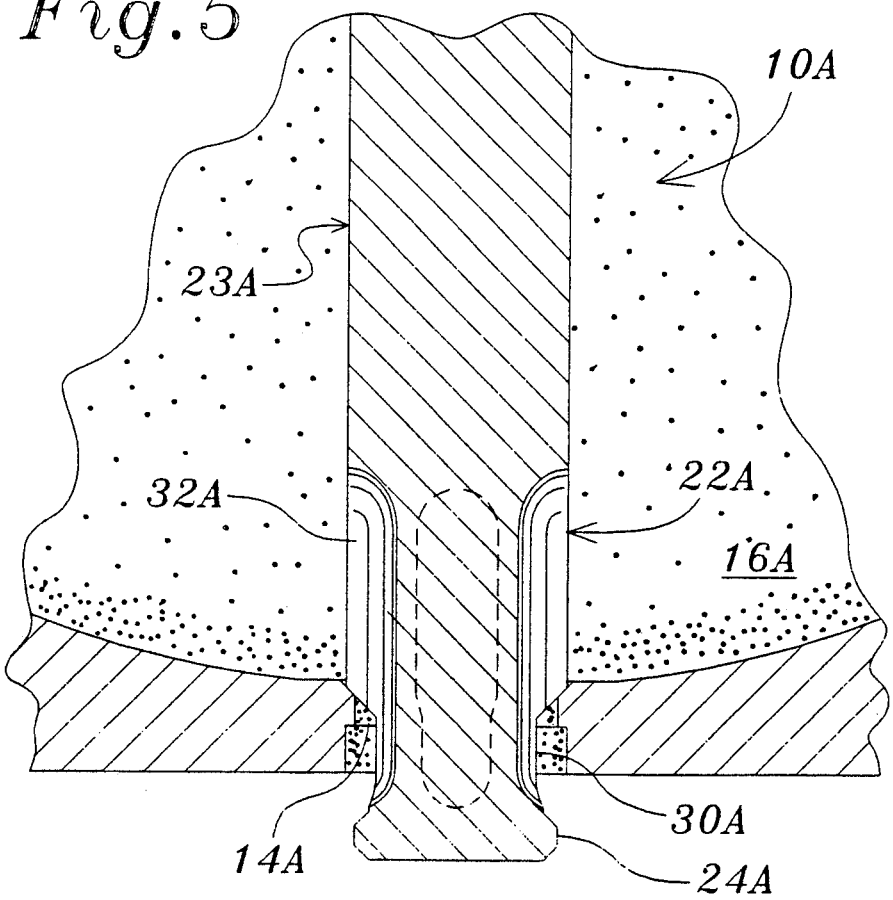
FIG. 5 illustrates a side elevation view, in section, of an alternate embodiment of the pouring device of the present invention.

In FIG. 5 an alternate embodiment of the device of the present invention is illustrated at 10A. Whereas it will be recognized that the removable retainer ring 12 of the embodiment of FIGS. 1–4 provides certain advantages, in the illustrated embodiment of FIG. 5 a separate retainer ring is not provided, and the crucible 16A defines the opening 14A into which the plug member 22A is inserted. Also, in the alternate embodiment of FIG. 5 the plug member 22A is integrally formed with a pouring rod 23A, rather than releasably mounted on the end of the pouring rod.

In light of the above, it will be recognized that the present invention provides a device for controlling the pouring of molten materials having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A device for controlling the pouring of a molten material from a container, said container defining a bottom portion provided with an opening through which said molten material is poured from said container, said device comprising:

a plug member having an annular forward end portion for force-fit reception in said opening of said container to selectively seal said opening and for being selectively forced through said opening of said container, said plug member having a rear end portion for being positioned within said container, said rear end portion including stop means for prohibiting said rear end portion from passing through said opening in said container when said forward end portion is selectively forced through said opening, said plug member defining at least one flute extending from a point rearward of said annular forward end portion and forward said stop means to a point rearward of said stop means, said flute permitting fluid communication between interior and exterior of said container when said forward end portion of said plug is forced through said opening whereby said molten material is allowed to flow from said container through said opening.

2. The device of claim 1 wherein said rear end portion of said plug member defines a preselected cross-sectional diameter greater than said forward end portion of said plug member so as to serve as said stop means for prohibiting said rear end portion from passing through said opening in said container when said forward end portion is selectively forced through said opening.

3. The device of claim 1 wherein said plug member defines a waist portion disposed between said forward end portion and said rear end portion, said waist portion defining a preselected cross-sectional diameter smaller than the cross-sectional diameter of said opening in said container.

4. The device of claim 2 wherein said plug member defines a waist portion disposed between said forward end portion and said rear end portion, said waist portion defining a preselected cross-sectional diameter smaller than the cross-sectional diameter of said opening in said container.

5. The device of claim 1 wherein said plug member defines a plurality of said flutes.

6. The device of claim 4 wherein said plug member defines a plurality of said flutes.

7. The device of claim 1 wherein said rear end portion of said plug member is provided with coupling means for engaging an outboard end of a pouring rod.

8. The device of claim 6 wherein said rear end portion of said plug member is provided with coupling means for engaging an outboard end of a pouring rod.

9. A device for controlling the pouring of a molten material from a container, said container defining a bottom portion provided with an opening through which said molten material is poured from said container, said device comprising:

a retainer ring for being received in said opening in said container, said retainer ring defining a further opening; and a plug member having an annular forward end portion for force-fit reception in said further opening of said retainer ring to selectively seal said further opening and for being selectively forced through said further opening, said plug member having a rear end portion for being positioned within said container, said rear end portion including stop means for prohibiting said rear end portion from passing through said further opening in said retainer ring when said forward end portion is selectively forced through said further opening, said plug member defining at least one flute extending from a point rearward of said annular forward end portion and forward said stop means to a point rearward of said stop means, said flute permitting fluid communication between interior and exterior of said container when said forward end portion of said plug is forced through said further opening whereby said molten material is allowed to flow from said container through said opening.

10. The device of claim 9 wherein said retainer ring is dimensioned for force-fit reception in an annular recess within said container and circumscribing said opening in said container.

11. The device of claim 9 wherein said rear end portion of said plug member defines a preselected cross-sectional diameter greater than the cross-sectional diameter of said forward end portion of said plug member so as to serve as said stop means for prohibiting said rear end portion from passing through said further opening when said forward end portion is selectively forced through said further opening.

12. The device of claim 10 wherein said rear end portion of said plug member defines a preselected cross-sectional diameter greater than the cross-sectional diameter of said forward end portion of said plug member so as to serve as said stop means for prohibiting said rear end portion from passing through said further opening when said forward end portion is selectively forced through said further opening.

13. The device of claim 9 wherein said plug member defines a waist portion disposed between said forward end portion and said rear end portion, said waist portion defining a preselected cross-sectional diameter smaller than the cross-sectional diameter of said further opening in said retaining ring.

14. The device of claim 12 wherein said plug member defines a waist portion disposed between said forward end portion and said rear end portion, said waist portion defining a preselected cross-sectional diameter smaller than the cross-sectional diameter of said further opening in said retainer ring.

15. The device of claim 9 wherein said plug member defines a plurality of said flutes.

16. The device of claim 14 wherein said plug member defines a plurality of said flutes.

17. The device of claim 9 wherein said rear end portion of said plug member is provided with coupling means for engaging an outboard end of a pouring rod.

18. The device of claim 16 wherein said rear end portion of said plug member is provided with coupling means for engaging an outboard end of a pouring rod.

* * * * *